United States Patent [19]

Griesbach

[11] 4,455,921

[45] Jun. 26, 1984

[54] PISTON-TYPE CONCRETE PUMP

[75] Inventor: Rolf Griesbach, Dortmund, Fed. Rep. of Germany

[73] Assignee: Maschinenfabrik Walter Scheele GmbH & Co. KG, Unna-Massen, Fed. Rep. of Germany

[21] Appl. No.: 290,695

[22] Filed: Aug. 6, 1981

[30] Foreign Application Priority Data

Aug. 8, 1980 [DE] Fed. Rep. of Germany ..... 3030005

[51] Int. Cl.[3] ..... F15B 13/06

[52] U.S. Cl. ..... 91/191; 91/520; 91/536; 417/342; 60/579; 60/581; 60/591

[58] Field of Search ..... 91/513, 520, 536, 191, 91/192, 448; 60/562, 591, 579, 581; 417/342, 900

[56] References Cited

U.S. PATENT DOCUMENTS

| | | | |
|---|---|---|---|
| 3,073,123 | 1/1963 | Hodgson et al. | 91/520 |
| 3,733,965 | 5/1973 | Braun | 417/342 |
| 4,243,106 | 1/1981 | Skubich et al. | 91/520 |

FOREIGN PATENT DOCUMENTS

| | | |
|---|---|---|
| 2441831 | 3/1976 | Fed. Rep. of Germany . |
| 2835590 | 4/1979 | Fed. Rep. of Germany . |
| 2925674 | 1/1981 | Fed. Rep. of Germany . |
| 568481 | 10/1975 | Switzerland . |

*Primary Examiner*—Robert E. Garrett
*Assistant Examiner*—Richard S. Meyer
*Attorney, Agent, or Firm*—Karl F. Ross; Herbert Dubno

[57] ABSTRACT

A concrete pump comprises a pair of separate pump assemblies each having a cylinder, a piston subdividing same into a piston-side front compartment and a rod-side rear compartment, and a piston rod connected to the respective piston and extending out of the respective cylinder through the respective rod-side rear compartment. The pump also has a liquid supply having a high-pressure side and a low-pressure side for supplying liquid under high pressure at the high-pressure side and for taking in liquid at the low-pressure side. The concrete pump is further provided with a mode valve connected to all of the compartments and to both of the supply sides and having at least one valve element movable between a piston-side position in which the high-pressure side is connected to one of the front compartments, the low-pressure side is connected to the other of the front compartments, and the rear compartments are connected together, and a rod-side position in which the high-pressure side is connected to one of the rear compartments, the low-pressure side is connected to the other of the rear compartments, and the front compartments are connected together. Thus the mode valve serves to energize the assemblies at the front sides in the piston-side position and at the rear sides in the rod-side position.

5 Claims, 4 Drawing Figures

PISTON-TYPE CONCRETE PUMP

FIELD OF THE INVENTION

The present invention relates to a piston-type concrete pump. More particularly this invention concerns such a pump having two separate and alternately operated piston-and-cylinder assemblies.

BACKGROUND OF THE INVENTION

A concrete pump is known having two separate piston-and-cylinder assemblies each comprising a cylinder, a pump subdividing same into a piston-side front compartment and a rod-side rear compartment, and a piston rod connected to the respective piston and extending out of the respective cylinder through the respective rod-side rear compartment. A liquid supply means having a high-pressure side and a low-pressure side can be connected via a reversing valve to these compartments to alternately operate them.

Such arrangements are normally divided into those of the piston-side pressurization type and the rod-side pressurization type. In the formar the reversing valve is connected to the front or piston-side compartments so as to presurize one while depressurizing the other, and vice versa, and the rod-side compartments are connected only to each other so that the liquid driven out of the one is taken into the other and vice versa. In the rod-side pressurization type the front or piston-side compartments are connected together and the reversing valve alternately pressurizes the rod-side or rear compartments.

Much time, energy, and speculation has been invested in determining which of these systems is best for which application. It appears that rod-size actuation is desirable in certain situations, and piston-side actuation in others. Nonetheless the user must opt for one system or the other when purchasing the machine. If a change is desired it is necessary to uncouple various hydraulic hoses, with concomitant loss of fluid, and recouple them in the appropriate manner, and then top off the reservoir to make up for the loss in fluid. Obviously such a procedure is onerous in the extreme, and leads owners of such concrete pumps often to use a type of actuation that is not suited to the job.

OBJECTS OF THE INVENTION

It is therefore an object of the present invention to provide an improved piston-type concrete pump.

Another object is the provision of such a pump which overcomes the above-given disadvantages of the known pumps.

SUMMARY OF THE INVENTION

These objects are attained according to the instant invention in a concrete pump comprising the standard pair of separate pump assemblies each having a cylinder, a piston subdividing same into a piston-side front compartment and a rod-side rear compartment, and a piston rod connected to the respective piston and extending out of the respective cylinder through the respective rod-side rear compartment. The pump also has the traditional liquid supply means having a high-pressure side and a low-pressure side for supplying liquid under high pressure at the high-pressure side and for taking in liquid at the low-pressure side. According to the instant invention the concrete pump is provided with mode-valve means connected to all of the compartments and to both of the supply-means sides and having at least one valve element movable between a piston-side position in which the high-pressure side is connected to one of the front compartments, the low-pressure side is connected to the other of the front compartments, and the rear compartments are connected together, and a rod-side position in which the high-pressure side is connected to one of the rear compartments, the low-pressure side is connected to the other of the rear compartments, and the front compartments are connected together. Thus the mode-valve means serves to energize the assemblies at the front sides in the piston-side position and at the rear sides in the rod-side position.

Thus with the system according to the instant invention it is possible for the user to switch relatively easily between piston-side and rod-side actuation, according to the needs of the job. Once the actuation mode is selected the arrangement operates in the classic manner.

According to further features of this invention the pump comprises a pair of main conduits between the liquid-supply means sides and the mode-valve means, and a four-port two-position reversing valve in the main conduits.

In accordance with another feature of this invention, the mode-valve means includes a six-port two-position mode valve, having on one valve side ports connected to the front and rear compartments of one of the piston-and-cylinder assemblies and to one of the compartments of the other assembly, and on the opposite valve side ports connected to the other compartment of the other assembly and to the high- and low-pressure sides of the supply means. This one compartment of the other assembly is normally the respective front compartment.

The valve element is movable only between the piston-side and rod-side positions, that is it cannot stay in an intermediate position blocking liquid flow between the supply and some of the compartments. Thus the mode valve cannot create a dangerous line-blocked situation.

In accordance with another feature of this invention, the mode-valve means includes two respective ganged four-port two-position valves each having on one side two ports connected to the sides of said supply means and on the other side two ports connected to the respective chambers of the respective assemblies.

DESCRIPTION OF THE DRAWING

The above and other features and advantages will become more readily apparent from the following, reference being made to the accompanying drawing in which.

SPECIFIC DESCRIPTION

Figures 1, 3A:
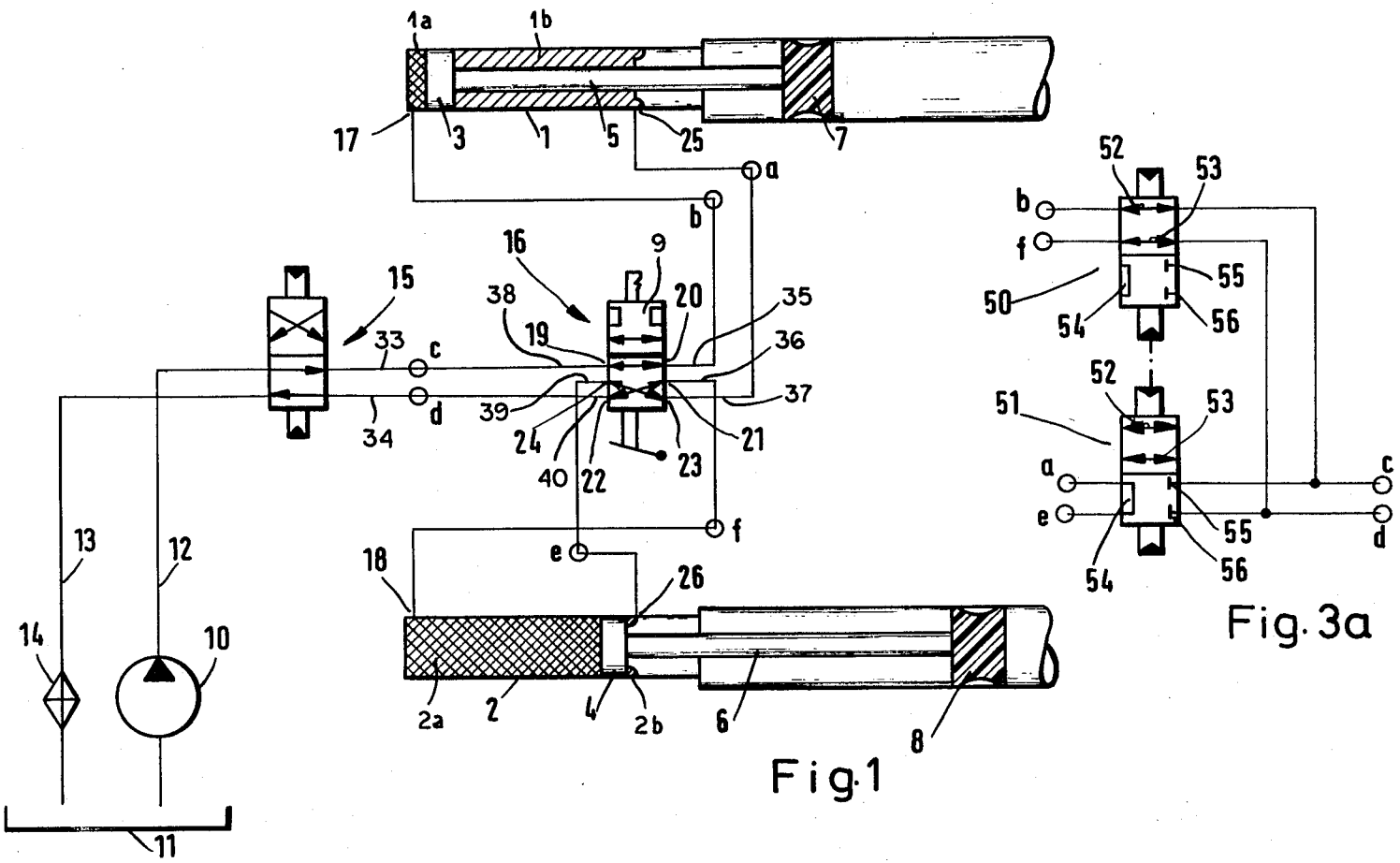
FIG. 1 is a schematic representation of the pump according to the instant invention in the piston-side actuation mode.
FIGS. 3*a* and 3*b* are views of alternative mode valves respectively in the positions of the pumps of FIGS. 1 and 2.

As seen in FIG. 1 a concrete pump has a pair of separate cylinders 1 and 2 provided with respective pistons 3 and 4 having respective piston rods 5 and 6 subdividing the interiors of the respective cyliners 1 and 2 into respective front or piston-side compartments 1*a* and 2*a* and respective rear or rod-side compartments 1b and 2b. The piston rods 5 and 6 in turn carry respective concrete-moving plungers 7 and 8 of standard construction.

A high-pressure pump 10 can draw hydraulic liquid from a sump or reservoir 11 and feed it to a high-pressure conduit 12. A return or low-pressure conduit 13 provided with a particle filter also opens into the sump or reservoir 11.

A standard four-port two-position slide-type reversing valve 15 is connected on one side to the high- and low-pressure conduits 12 and 13 and on the other side to conduits 33 and 34. A mode valve 16 is in turn connected between this reversing valve 15 and the compartments 1a, 1b, 2a, and 2b of the cylinders 1 and 2.

This mode valve 16 is of the six-port two-position slide type. It has on one side ports 35, 36, and 37 connected to respective ports 17, 18, and 25 opening into the compartments 1a, 2a, and 1b, and on the other side ports 38, 39, and 40 connected via appropriate conduits to the lines 33 and 34 and to the port 26 opening into the compartment 2b. This valve 16 has a valve element 9 whose lower part is formed on one side with connections 20, 21, and 23 alignable with the ports 35, 36, and 37 and on the other side connections 19, 24, and 22 alignable with the ports 38, 39, and 40. The valve body 9 further has, as shown in FIG. 2, an upper port formed with connections 27, 28, and 32 alignable with the ports 35, 36, and 37, and on the other side connections 29, 30, and 31 alignable with the ports 38, 39, and 40.

In the FIG. 1 piston-side actuation position of the apparatus the valve 16 connects the conduit 33, which here is shown connected to the high-pressure conduit 12 by the valve 15, to the front compartment 1a to pressurize it. Simultaneously the valve 16 connects the front compartment 2a to the line 34 which is connected to the low-pressure line 13. Finally the two compartments 1b and 2b are connected together. The high-pressure fluid in the compartment 1a will therefore drive the fluid out of the compartment 1b and into the compartment 2b, therefore driving the fluid out of the compartment 2a to the reservoir 11. When the reversing valve 15 is switched over, connecting the high-pressure conduit 12 to the line 34 and the low-pressure conduit 13 to the line 33, the compartment 2a will be pressurized and the compartment 1a depressurized in reverse fashion. Either way the fluid shown in simple diagonal hatching is merely shunted back and forth between the compartments 1b and 2b while the fluid shown in cross hatching is moved directly by the pump 10.

Figures 2, 3B:
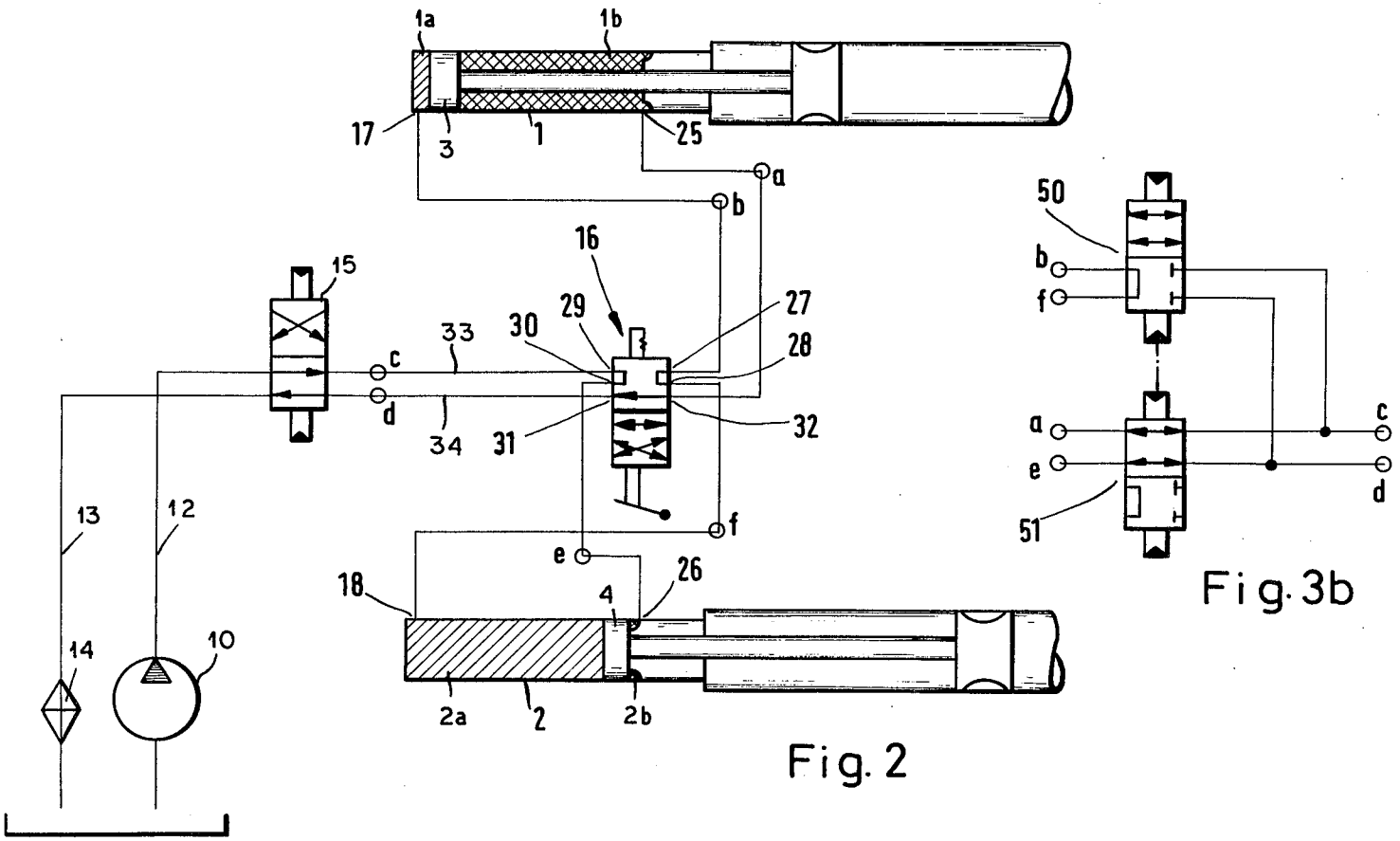
FIG. 2 is a view similar to FIG. 1 showing the pump in the rod-side actuation mode.

In the rod-side actuation position of FIG. 2, the valve 16 connects the depressurized line 34 directly to the compartment 1b, connects the compartment 2b to the pressurized line 33, and interconnects the two compartments 1a and 2a. Thus the fluid shown in simple diagonal hatching in these compartments 1a and 2a is shunted back and forth.

According to this invention the valve 15 is controlled by pilot valves or switches in turn connected to the piston rods 5 and 6 and opened and closed in dependence on the positions thereof. Once the one piston 7 or 8 reaches its end position the valve 15 is reversed until the other piston reaches its end position, thereby cycling back and forth with the pistons 7 and 8 alternately sucking in and expelling concrete through appropriate entrance and exit valves, normally of the slide-valve type.

FIGS. 3a and 3b show how a pair of ganged four-port two-position slide valves can replace the valve 16. To this end connections a–e are indicated in FIGS. 1 and 2 and in FIGS. 3a and 3b to indicate how these valves 50 and 51 replace the valve 16, it being understood that, for example, the part of the valve 50 connected to connection f is connected to the same connection f in FIG. 1. Each of the valves 50 and 51, as seen in FIG. 3a, has an upper portion with straight feedthroughs 52 and 53 and a lower portion with a pair of shunts 54 and a pair of blind connections 55 and 56. These valves 50 and 51 function together to make the same connections as the valve 16 as can be seen readily by a comparison of FIG. 3a, which shows the valves 50 and 51 in the piston-side actuation position, with FIG. 1 and by a comparison of FIG. 3b, which shows the valves 50 and 51 in the rod-side actuation position, with FIG. 2.

The system of the instant invention, therefore, allows the user to switch with great ease between rod-side or piston-side actuation. Such a switchover can be effected in an instant, with no loss of hydraulic fluid. Indeed in the middle of a pumping operation if, for example, one of the pistons becomes stuck, it is possible to switch actuation styles to free it. Such a possibility has not existed in any of the prior-art systems.

I claim:

1. A concrete pump comprising:

a pair of separate pump assemblies each having a cylinder, a piston subdividing same into a piston-side front compartment and a rod-side rear compartment, and a piston rod connected to the piston and extending out of the cylinder through the rod-side rear compartment;

liquid supply means having a high-pressure side and a low-pressure side for supplying liquid under high pressure at said high-pressure side and for taking in liquid at said low-pressure side; and mode-valve means connected to all of said compartments and to both of said sides and having a single valve element movable between:

a piston-side position in which said high-pressure side is connected to the front compartment of one of said assemblies, said low-pressure side is connected to the other of said front compartments, and said rear compartments are connected together; and a rod-side position in which said high-pressure side is connected to the rear compartment of the other of said assemblies, said low-pressure side is connected to the other of said rear compartments, and said front compartments are connected together, for direct energization of said assemblies at said front compartment of said one assembly in said piston-side position and at said rear compartment of said other assembly in said rod-side position.

2. A concrete pump comprising:

a pair of separate pump assemblies each having a cylinder, a piston subdividing same into a piston-side front compartment and a rod-side rear compartment, and a piston rod connected to the piston and extending out of the cylinder through the rod-side rear compartment;

liquid supply means having a high-pressure side and a low-pressure side for supplying liquid under high pressure at said high-pressure side and for taking in liquid at said low-pressure side;

mode-valve means connected to all of said compartments and to both of said sides and having a single valve element movable between;

a piston-side position in which said high-pressure side is connected to the front compartment of one of said assemblies, said low-pressure side is connected to the other of said front compartments, and said rear compartments are connected together; and a rod-side position in which said high-pressure side is connected to the rear compartment of the other of said assemblies, said low-pressure side is connected to the other of said rear compartments, and said front compartments are connected together, for direct energization of said assemblies at said front compartment of said one assembly in said piston-side position and at said rear compartment of said other assembly in said rod-side position;

a pair of main conduits between said sides and said mode-valve means; and a four-port two-position reversing valve in said main conduits, whereby any of said compartments can be connected to said high-pressure side.

3. The assembly defined in claim 1 wherein said mode-valve means includes a six-port two-position mode valve, having on one valve side ports connected to the front and rear compartments of one of said assemblies and to one of the compartments of the other assembly, and on the opposite valve side ports connected to the other compartment of said other assembly and to said sides of said supply means.

4. The pump defined in claim 3 wherein said one compartment of said other assembly is the respective front compartment.

5. The pump defined in claim 1 wherein said valve element is movable only between said positions.

* * * * *